US007019431B1

(12) United States Patent
Kerlin

(10) Patent No.: US 7,019,431 B1
(45) Date of Patent: Mar. 28, 2006

(54) HYDRODYNAMIC SLIP RING

(75) Inventor: Jack H. Kerlin, Provo, UT (US)

(73) Assignee: RT Patent Company, Inc., Wilmington, DE (US)

( * ) Notice: Subject to any disclaimer, the term of this patent is extended or adjusted under 35 U.S.C. 154(b) by 7 days.

(21) Appl. No.: 10/970,821

(22) Filed: Oct. 20, 2004

(51) Int. Cl.
*H01R 39/08* (2006.01)

(52) U.S. Cl. ..... 310/232

(58) Field of Classification Search ..... 310/232; H01R 39/08
See application file for complete search history.

(56) References Cited

U.S. PATENT DOCUMENTS 2,555,997 A * 6/1951 Porail ..... 310/219
3,163,792 A * 12/1964 Sayers ..... 310/102 R
4,047,063 A * 9/1977 Reece et al. ..... 310/232
4,171,496 A * 10/1979 Eriksson ..... 310/219
5,866,967 A * 2/1999 Sasaki ..... 310/232

FOREIGN PATENT DOCUMENTS

GB 1468155 A * 3/1977
JP 07245163 A * 9/1995

* cited by examiner

*Primary Examiner*—Joseph Waks
(74) *Attorney, Agent, or Firm*—Jones Day

(57) ABSTRACT

A slip ring assembly for transferring electrical current to an electrical device is disclosed. The slip ring assembly has a housing that is attachable to the electrical device. Disposed within the housing is a rotatable slip ring and a flexible conductor. The flexible conductor is configured to conform to the shape of the slip ring and conduct an electric current. A fluid is contained within the housing. The fluid forms a conductive film between the slip ring and the conductor when the slip ring rotates through hydrodynamic forces. The conductive film is operative to transfer electrical current between the slip ring and the conductor while also preventing wear of the slip ring and conductor.

25 Claims, 2 Drawing Sheets

HYDRODYNAMIC SLIP RING

FIELD OF THE INVENTION

The present invention generally relates to brushes for an electric motor and more particularly to a slip-ring submerged in an liquid medium in order to decrease wear of the brushes, and, increase current density and heat removal.

BACKGROUND OF THE INVENTION

Filamentary metal brushes have been used to transfer electrical energy from a power source to the rotating member of a machine. The brushes comprise a plurality of fine hair-like metallic fibers that are individually suspended independent of the surrounding fibers. Each of the fibers provides a discrete contact point with a metallic ring surface of the rotating member of the electrical machine. Accordingly, numerous contact points are established and act in concert to conduct electrical current between the brushes and the rotating member of the electrical machine.

As the amount of current has increased in electrical machines, the format of the brushes has changed. In order to handle large amounts of current, the hair-like brushes have been replaced by solid blocks of graphite which provide greater serviceability. Graphite has been used because it provides natural lubrication and vaporizes at a high temperature rather than melts. Furthermore, the formation of a protective film on the ring surface is formed from the presence of atmospheric humidity and oxygen. The protective film shifts wear from the ring to the brush which is easily replaced during routine machine maintenance.

The graphite brushes wear out from both electrical wear and mechanical wear. The electrical wear results from the vaporization of the graphite at scattered contact points of the ring that randomly move across the interface surface. Mechanical wear results from the dry mechanical friction between the graphite and the surface of the metallic ring. In order to ensure proper operation of the electrical motor, inspection and servicing of the graphite brushes are required.

Recently, metal fiber brushes have been incorporated into electrical motor designs. These brushes incorporate numerous metal fibers bound together into a solid block that resembles a standard graphite brush. The fibers are fused or bonded together using a matrix material. However, these brushes cannot handle the high current density required for industrial applications.

SUMMARY OF THE INVENTION

In accordance with the present invention there is provided a slip ring assembly for transferring electrical current to an electrical device such as a rotating machine. The slip ring assembly has a housing that is attachable to the electrical device. Disposed within the housing is a rotatable slip ring and a flexible conductor. The flexible conductor is configured to conform to the shape of the slip ring and conduct an electric current. A fluid is contained within the housing. The fluid forms a conductive film between the slip ring and the conductor when the slip ring rotates through hydrodynamic forces. The conductive film is operative to transfer electrical current between the slip ring and the conductor while also preventing wear of the slip ring and flexible conductor.

The slip ring is attached to a rotatable shaft of the electrical device. In this respect, the shaft extends through the housing and is supported by a seal and/or bearing. In order to attach the slip ring to the shaft, the assembly can include first and second insulators attached to respective first and second sides of the slip ring and the shaft. The insulators electrically isolate the slip ring from the shaft.

It is possible to have two slip rings disposed within the housing and attached to the shaft. In this configuration, a second flexible conductor is used with the second slip ring. The second slip ring may be attached to the shaft with respective insulators and a center separator may be used to separate the first and second slip rings from one another.

Typically, the slip ring has a groove formed in the outer circumference thereof. The groove is sized and configured to receive the flexible conductor. The flexible conductor may be a braided strap which partially wraps around the slip ring.

In accordance with the present invention, there is provided a method of conducting electrical current between a power source and an electrical device with the slip ring assembly. The method comprises rotating the slip ring within the housing to form a conductive film with fluid between the flexible conductor and the slip ring. Next, electrical current is transferred between the flexible conductor and the slip ring. The conductive film formed by the fluid prevents wear to the slip ring and flexible conductor.

BRIEF DESCRIPTION OF THE DRAWINGS

These, as well as other features of the present invention, will become more apparent upon reference to the drawings wherein.

DETAILED DESCRIPTION

Figure 1:
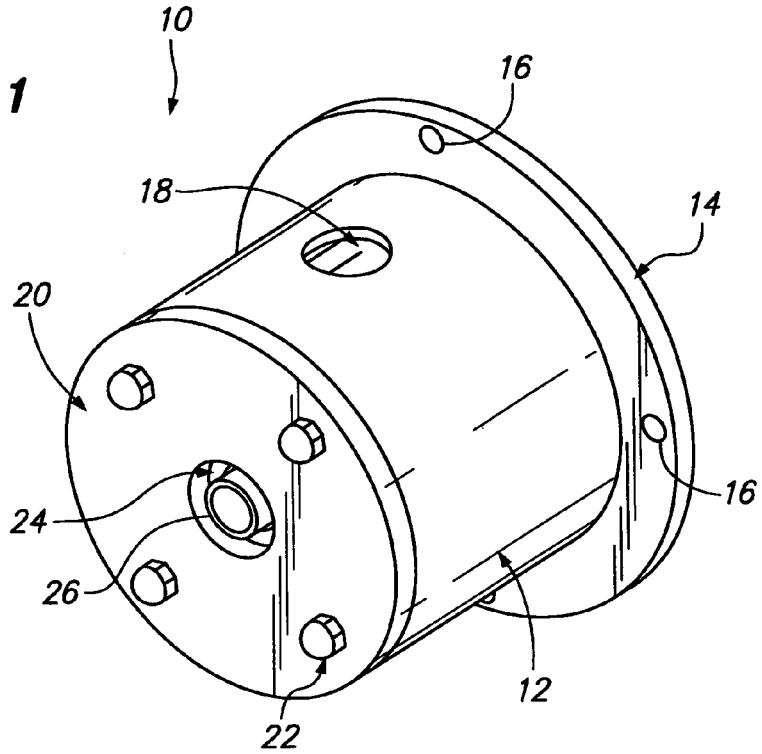
FIG. 1 is a perspective view of a hydrodynamic slip ring.

Referring now to the drawings wherein the showings are for purposes of illustrating preferred embodiments of the present invention only, and not for purposes of limiting the same, FIG. 1 is a perspective view of a hydrodynamic slip ring assembly 10. The slip ring assembly 10 is used to transfer electrical energy between a power source and an electrical machine. The slip ring assembly 10 is a self-contained unit and is adapted to be mounted onto a shaft of an electric motor. The slip ring assembly 10 has a housing 12 with a mounting flange 14 that is adapted to be attached to the electric motor. The mounting flange 14 can be formed integral with the housing 12 or be a separate piece attached thereto. The mounting flange 14 has a series of apertures 16 for inserting a mounting bolt of the motor therethrough. The housing 12 is generally cylindrical and has a liquid fill port 18 formed therein for filling the housing 12 with a fluid. The fill port 18 may be capped with an appropriate device in order to prevent fluid from leaking from the housing 12.

Attached to an end of the housing 12 opposite the flange 14 is an end plate 20 that is secured with tie-rod nuts 22. The end plate 20 is tightened up against the housing 12 with the nuts 22 to prevent fluid from leaking from the housing 12. A washer or seal can be inserted between end plate 20 and the housing 12 to further prevent fluid from leaking from the housing 12.

The end plate 20 further includes a shaft bearing and seal 24 for supporting a rotating shaft 26 of the motor. As will be further explained below, the shaft 26 supports the metallic slip rings of the slip ring assembly 10. The shaft bearing and seal 24 supports the shaft 26, while allowing rotation thereof. Furthermore, the shaft bearing and seal 24 prevents fluid from leaking from between the shaft 26 and the end plate 20.

Figure 2:
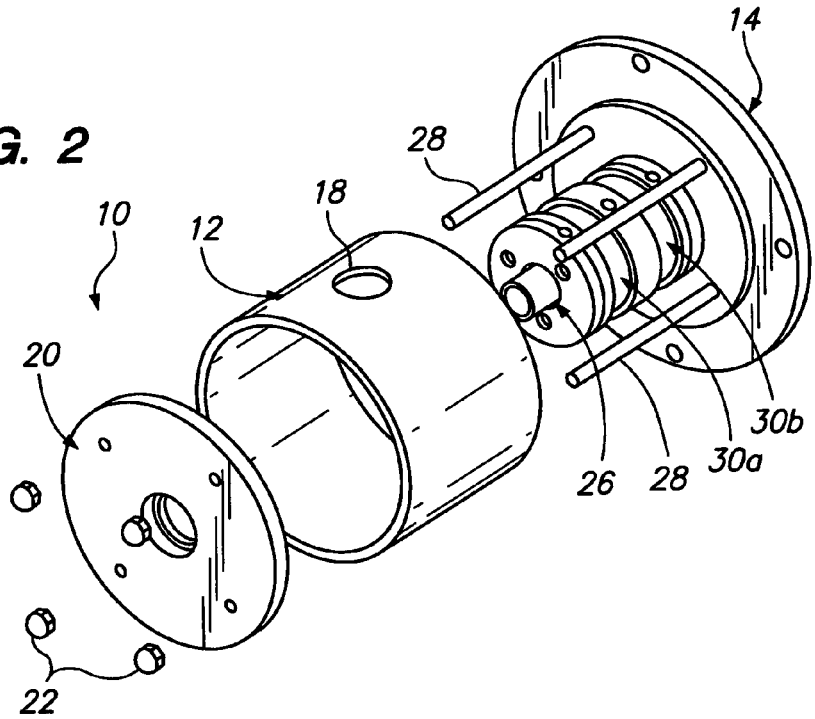
FIG. 2 is an exploded perspective view of the slip ring shown in FIG. 1.

Referring now to FIG. 2, the slip ring assembly 10 has tie rods 28 that are used to secure the endplate 20 to the housing 12. The tie rods 28 may be threaded such that tie rod nuts 22 are attached thereto. In this respect, the tie rod nuts 22 are threaded onto the tie rods 28 in order to compress the housing 12 between the endplate 20 and the mounting flange 14. The endplate 20 and the mounting flange 14 support the shaft 26. Disposed on the shaft 26 are two metallic slip rings 30*a*, 30*b*. The slip rings 30 are generally circular and mounted to the shaft via insulators, as will be further explained below. The slip rings 30 are fixedly mounted to the shaft 26 such that when the shaft 26 rotates, the slip rings 30 also rotate.

Figure 3:
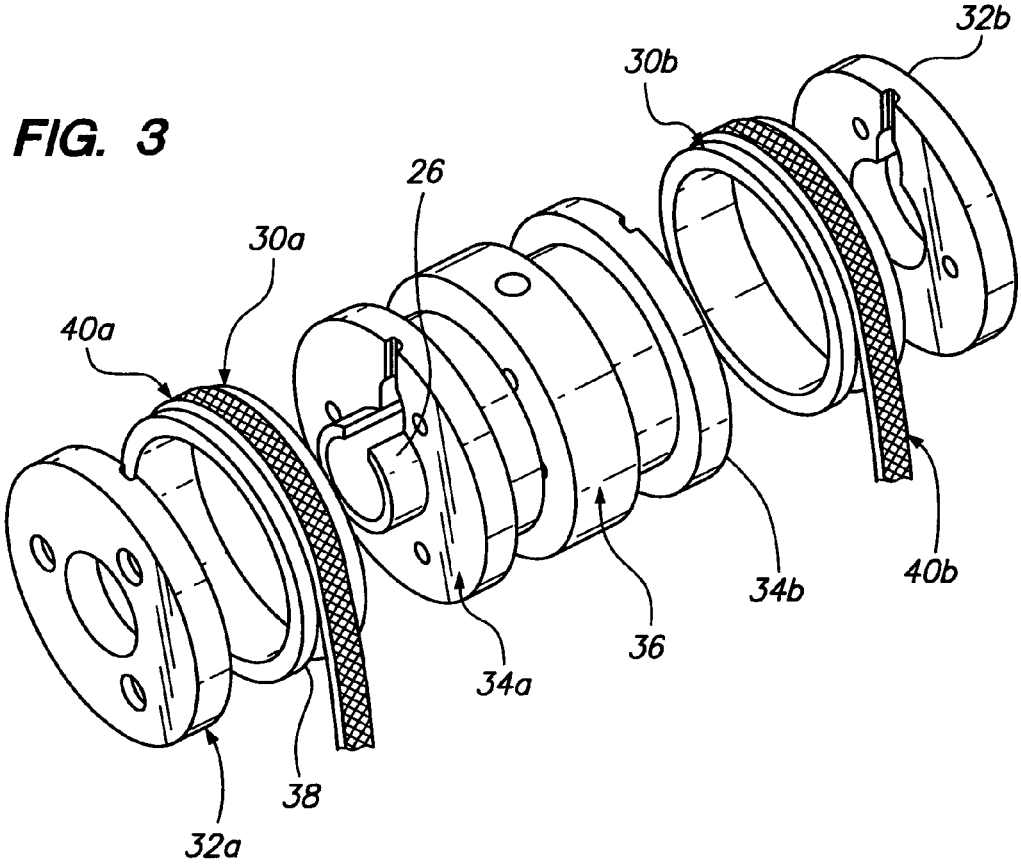
FIG. 3 is an exploded perspective view of the ring and strap components for the slip ring shown in FIGS. 1 and 2.

Referring to FIG. 3, the slip rings 30 are mounted to the shaft 26 with end insulators 32*a*, 32*b*, center insulators 34*a*, 34*b* and an insulated center separator 36. Specifically, end insulator 32*a* is attached to both the shaft 26 and a side of the slip ring 30*a*. In this regard, the end insulator 32*a* supports the slip ring 30*a* from contacting the shaft 26 and conducting electrical energy thereto. The end insulator 32*a* is fabricated from an insulating material that does not conduct electrical energy. Typically, the end insulator 32*a* abuts one side of the slip ring 30*a*, as seen in FIG. 3 and may be keyed to align with the slip ring 30*a*, as well as with the shaft 26. The slip ring 30*a* is supported on the other side opposite the side with end insulator 32*a* by the center insulator 34*a* in the same manner.

The second slip ring 30*b* is similarly supported by the second end insulator 32*b* and the second center insulator 34*b*. In this regard, the second slip ring 30*b* is sandwiched between end insulator 32*b* and center insulator 34*b*. The slip ring 30*b*, end insulator 32*b* and center insulator 34*b* may be keyed in order to facilitate alignment. In order to further isolate the slip rings 30*a*, 30*b* and center insulators 34*a*, 34*b*, the slip ring assembly 10 further includes a center separator 36 that is mounted to the shaft 26. The center separator 36 is fabricated from an electrically insulating material and is attached to both of the center insulators 34*a*, 34*b*, as well as the shaft 26. In this respect, the center separator 36 spaces the slip rings 30*a*, 30*b*, as well as the center insulators 34*a*, 34*b* axially along the shaft 26. The end insulators 32, center insulators 34 and center separator 36 may be bolted together in order to sandwich the slip rings 30 into position.

Even though, there are two slip rings 30*a*, 30*b* shown in FIGS. 1–3, it will be recognized by those of ordinary skill in the art that any number of slip rings 30 can be attached to the shaft 26 with the appropriate end insulators 32, center insulators 34 and center separators 36. The number of slip rings 30, along with the number of end insulators 32, center insulators 34 and center separators 36 can depend upon the type of application such as the power rating for the motor and/or the number of phases for the electrical energy that powers the motor. Furthermore, it will be recognized that the center insulator 34 and the center separators 36 can be formed from a single unit.

Each of the slip rings 30 has a channel or groove 38 formed on the outer circumference thereof. The groove 38 of each slip ring 30 is sized and configured to receive a flexible braided conductor 40 which partially wraps around the outer circumference of the slip ring 30. In this respect, the conductor 40 may be a strap which can conform to the circular shape of the circumference of the slip ring 30. The braided conductor 40 is fabricated from an electrically conductive material such as copper. As seen in FIG. 3, slip ring 30*a* receives braided conductor 40*a*, while slip ring 30*b* receives braided conductor 40*b*. A large mating surface is formed between the groove 38 of each slip ring 30 and a respective one of the braided conductors 40. Each of the braided conductors 40 is electrically connected to an electrical energy power source so that electrical current flows through the braided connector and into the slip ring 30. For example, each braided conductor 40 may be connected to terminals on the housing 12 that allow the transfer of electrical current. Tension springs may be used to ensure that a radial force is applied to the each of the braided conductors 40 so that a tight clearance is maintained between the braided conductors 40 and respective slip rings 30.

Each of the slip rings 30 is attached to a wire conductor (not show) that carries electric current from the slip ring 30 to the motor. Specifically, the wire conductors are soldered or otherwise attached to the slip ring 30 and run through the shaft 26 to the motor. Each wire conductor is insulated to prevent electrical current from being transferred to other members of the slip ring assembly 10.

In operation, the housing 12 serves as a containment vessel for a conductive fluid into which each of the slip rings 30 and braided conductors 40 are immersed. The fluid is prevented from escaping the housing 12 with the seals 24. The housing 12 is filled by pouring the fluid through the fill port 18. The fluid is of a non-metallic composition such that hazardous metals such as mercury and low-melting-temperature eutectic alloys are not required. Organic liquids such a hydrocarbon oils degrade through carbonization with the passage of electric current and therefore are not suitable as a conductive medium despite their high lubricity. Various aqueous-based liquid solutions of salts and acids provide the ionic electrical conduction as well as necessary viscosity for use in the slip ring assembly 10. This type of fluid creates a very thin film between the braided conductor 40 and the respective slip ring 30 such that the overall electrical resistance of the fluid is very low. A typical fluid can be water.

As the shaft 26 rotates, hydrodynamic forces from the fluid contained within the housing 12 develop between the each of the braided conductors 40 and respective slip rings 30. The hydrodynamic forces prevent direct physical contact between the braided conductors 40 and slip rings 30 such that mechanical wear of the slip rings 30 and conductors 40 is prevented. Because the fluid is an electrically conducting medium, electrical energy is still transferred from the braided conductors 40 to a respective slip ring 30. The electrical conduction is facilitated by the ionic properties of the liquid film separating the braided conductor 40 and a respective slip ring 30. Furthermore, electrical wear is mitigated by the thermal quenching of the fluid such that localized hot spots, pitting and vaporization of the sliding surfaces is prevented.

It will be appreciated by those of ordinary skill in the art that the concepts and techniques described here can be embodied in various specific forms without departing from the essential characteristics thereof. For example, the slip ring assembly 10 may be used in various other formats including linear and rotary elements through which electric current is to be conducted. The presently disclosed embodiments are considered in all respects to be illustrative and not restrictive. The scope of the invention is indicated by the appended claims, rather than the foregoing description, and all changes that come within the meaning and range of equivalents thereof are intended to be embraced.

What is claimed is:

1. A slip ring assembly for transferring electrical current to an electrical device, the slip ring assembly comprising:

a housing;

a rotatable slip ring disposed within the housing;

a flexible conductor disposed within the housing and configured to conform to the shape of the slip ring, the conductor being operative to conduct electric current; and a fluid contained within the housing, the fluid being operative to form a conductive film between the slip ring and the conductor when the slip ring rotates such that wear to the slip ring and flexible conductor is prevented when electric current flows between the conductor and the slip ring.

2. The slip ring assembly of claim 1 further comprising a shaft attached to the slip ring, the shaft being operative to rotate the slip ring.

3. The slip ring assembly of claim 2 wherein the shaft is attached to a rotating member of the electrical device.

4. The slip ring assembly of claim 2 further comprising at least one insulator configured to attach the slip ring to the shaft.

5. The slip ring assembly of claim 4 wherein the insulator is configured to prevent electric current from the slip ring to flow into the shaft.

6. The slip ring assembly of claim 4 wherein the insulator comprises a first insulator attached to a first side of the slip ring and a second insulator attached to a second side of the slip ring, the first and second insulators being operative to attach the slip ring to the shaft.

7. The slip ring assembly of claim 6 further comprising a second slip ring and a second flexible conductor, the second slip ring attached to the shaft with a third insulator and a fourth insulator.

8. The slip ring assembly of claim 7 further comprising a center separator configured to separate the first and second slip rings.

9. The slip ring assembly of claim 1 wherein the slip ring comprises a groove sized and configured to receive the flexible conductor.

10. The slip ring assembly of claim 1 wherein the flexible conductor is a braided strap.

11. The slip ring assembly of claim 1 wherein the fluid is water.

12. The slip ring assembly of claim 1 wherein the electrical device is a rotating machine.

13. A method of conducting electrical current between a power source and an electrical device with a slip ring assembly having a housing filled with a fluid, a rotatable slip ring disposed within the housing and a flexible conductor disposed within the housing and configured to conform to the shape of the slip ring; the method comprising the following steps:

rotating the slip ring within the housing to form a conductive film between the flexible conductor and the slip ring with the fluid; and transferring electric current between the flexible conductor and the slip ring, the conductive film preventing wear to the slip ring and flexible conductor.

14. The method of claim 13 wherein the step of rotating the slip ring comprises rotating the slip ring with a rotating shaft of the electrical device.

15. The method of claim 14 further comprising the step of isolating the slip ring from the shaft with an insulator attached to the shaft and the slip ring.

16. The method of claim 15 further comprising the step of transferring electrical current between a second rotating slip ring and a second flexible conductor, the fluid contained within the housing forming a conductive film between the second slip ring and the second flexible conductor thereby preventing wear therebetween.

17. A slip ring assembly for transferring electrical current in a rotating electric machine having a rotating shaft, the slip ring assembly comprising:

a housing attached to the electric machine wherein the shaft extends into the housing;

a slip ring having a groove formed in an outer circumference thereof, the slip ring being attached to the shaft;

a flexible conductor disposed within the housing and sized and configured to partially wrap around the outer circumference of the slip ring in the groove, the conductor being operative to transfer electrical current between the slip ring and conductor; and a fluid contained within the housing, the fluid being operative to form a conductive film between the slip ring and the conductor when the slip ring rotates, the conductive film preventing wear to the slip ring and flexible conductor when current flows between the flexible conductor and the slip ring.

18. The slip ring assembly of claim 17 further comprising a first insulator and a second insulator attached to the shaft and respective first and second sides of the slip ring, the first and second insulators configured to attach the slip ring to the shaft.

19. The slip ring assembly of claim 17 wherein the housing comprises a fill port for pouring the fluid into the housing.

20. The slip ring assembly of claim 17 wherein the housing comprises a seal for supporting the shaft and preventing fluid from leaking from the housing.

21. An assembly for transferring electrical power in an electrical device, the assembly comprising: housing means;

slip ring means in electrical communication with the electrical device and disposed within the housing means, the slip ring means being rotatable;

a flexible conductor disposed within the housing and configured to conform to the shape of the slip ring, the conductor being operative to conduct electric current; and fluid means contained within the housing, the fluid means for forming a conductive film between the slip ring means and the conduction means when the slip ring means rotates to thereby prevent wear to the slip ring means and conduction means when current flows through the conduction means and the slip ring means.

22. The assembly of claim 21 wherein the conductor is a braided strap.

23. The assembly of claim 21 wherein the slip ring means is generally circular.

24. The assembly of claim 23 wherein the slip ring means comprises a groove formed in an outer circumference thereof.

25. The assembly of claim 24 wherein the groove is sized and configured to receive the conductor.

* * * * *